US005302414A

United States Patent [19]

Alkhimov et al.

[11] Patent Number: 5,302,414

[45] Date of Patent: Apr. 12, 1994

[54] GAS-DYNAMIC SPRAYING METHOD FOR APPLYING A COATING

[75] Inventors: Anatoly P. Alkhimov; Anatoly N. Papyrin, ulitsa Vyazemskogo 2, kv. 72; Vladimir F. Kosarev; Nikolai I. Nesterovich; Mikahil M. Shushpanov, all of Novosibirsk, U.S.S.R.

[73] Assignee: Anatoly Nikiforovich Papyrin, Novosibirsk, U.S.S.R.

[21] Appl. No.: 781,233

[22] PCT Filed: May 19, 1990

[86] PCT No.: PCT/SU90/00126

§ 371 Date: Feb. 2, 1992

§ 102(e) Date: Feb. 2, 1992

[87] PCT Pub. No.: WO91/19016

PCT Pub. Date: Dec. 12, 1991

[51] Int. Cl.[5] ..... B05D 1/12

[52] U.S. Cl. ..... 427/192; 427/191; 427/195

[58] Field of Search ..... 427/34, 189, 190, 191, 427/192, 195, 422, 423, 427, 421, 447, 455, 456; 419/9; 428/937

[56] References Cited

U.S. PATENT DOCUMENTS

| | | | |
|---|---|---|---|
| 2,861,900 | 11/1958 | Smith et al. | 427/446 |
| 4,235,943 | 11/1980 | McComas et al. | 427/191 |
| 4,256,779 | 3/1981 | Sokol et al. | 427/34 |
| 4,289,807 | 9/1981 | Christensen et al. | 427/195 |
| 4,416,421 | 11/1983 | Browning | 239/79 |
| 4,627,990 | 12/1986 | Saga et al. | 427/191 |
| 4,815,414 | 3/1989 | Duffy et al. | 118/308 |
| 4,928,879 | 5/1990 | Rotolico | 427/34 |
| 5,019,429 | 5/1991 | Moskowitz et al. | 427/423 |

OTHER PUBLICATIONS

"30,000 Degrees With The Plasma Jet", Journal of Metals (Jan. 1959) pp. 40–42.

*Primary Examiner*—Terry J. Owens

*Attorney, Agent, or Firm*—Ladas & Parry

[57] ABSTRACT

A cold gas-dynamic spraying method for applying a coating to an article introduces into a gas particles of a powder of a metal, alloy, polymer or mechanical mixture of a metal and an alloy, the particles having a particle size of from about 1 to about 50 microns. The gas and particles are formed into a supersonic jet having a temperature considerably below a fusing temperature of the powder material and a velocity of from about 300 to about 1,200 m/sec. The jet is directed against an article of a metal, alloy or dielectric, thereby coating the article with the particles.

6 Claims, 2 Drawing Sheets

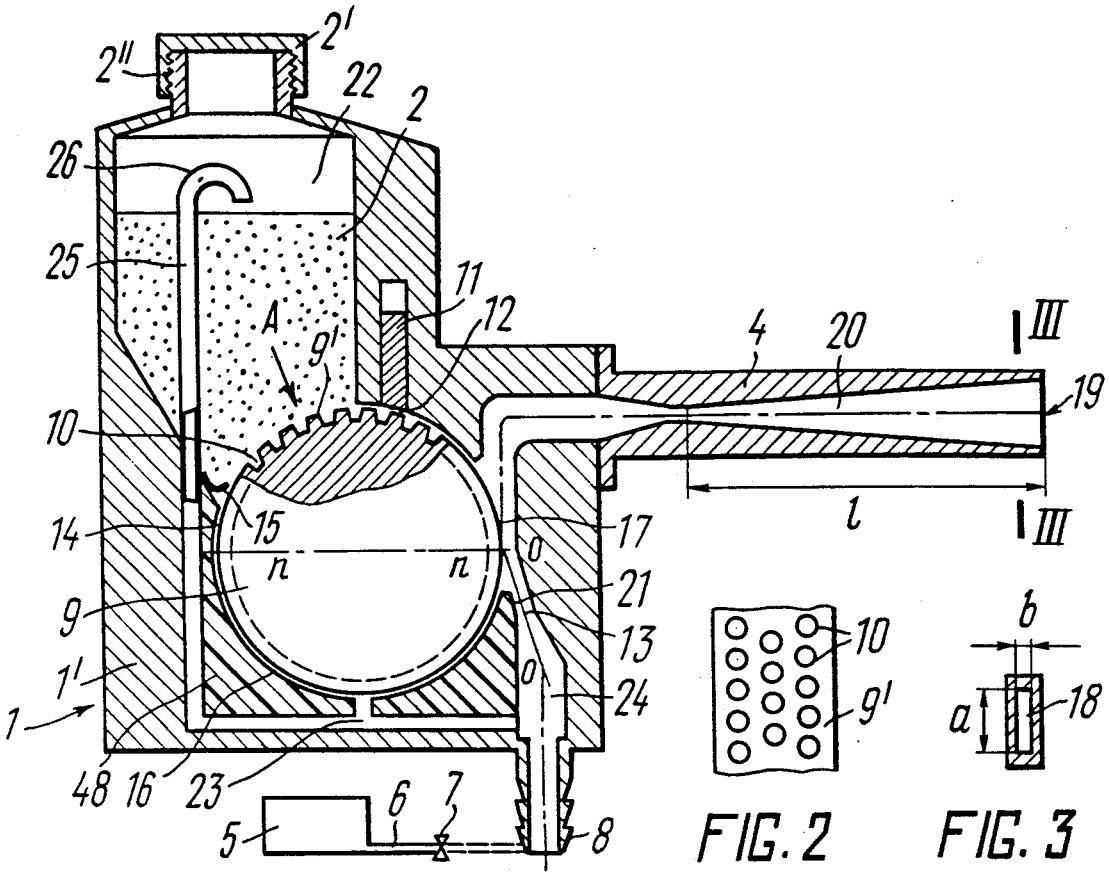
FIG. 1
FIG. 2
FIG. 3
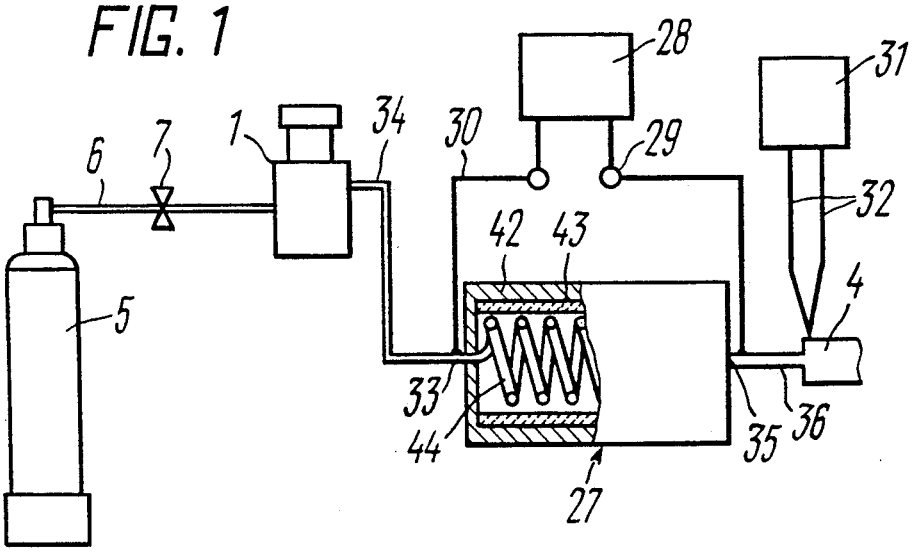
FIG. 4

GAS-DYNAMIC SPRAYING METHOD FOR APPLYING A COATING

The present invention relates to metallurgy, more specifically, a method of and an apparatus for applying a coating.

BACKGROUND ART

Protection of structures, equipment, machines, and mechanisms made of ferrous metals from corrosion and effect exerted by aggressive media, an improvement of specifications of materials, including obtaining materials with prescribed properties, and development of resource-saving processing technologies are important scientific, technical and practical problems.

These problems can be solved by various methods, including applying powder coatings with widely usable gas flame-spray, electric arc, detonation and plasma methods.

The gas flame-spray method is based on gas combustion products used at 1000° to 3000° C., creation of a flow of these gases in which powder particles being applied are fused. A velocity of 50 to 100 m/s is imparted to said particles, and the surface is treated with the gas and powder flow containing the fused particles. This treatment results in a coating. The low values of velocity and temperature of the applied particles substantially limit application of this method.

The explosive method eliminates these disadvantages in part, according to which the energy of detonating gases at 2000° to 3500° C. is used owing to which fact the velocity of the particles is substantially increased up to 400 to 700 m/s and their temperature is increased up to 2000° to 3500° C. to ensure application of coatings of powders of metals, alloys, and dielectrics. This method is highly disadvantageous in low productivity explained by the impact acceleration process of deposition: a resulting shock wave and a gas flow following it cause a high level of a thermal and dynamic pulse effect produced upon the product and also of acousting noise which restricts the possibilities of application of this method.

The most promising is a method of plasma deposition consisting in application of a powder coating to the surface of a product with a high-temperature gas jet (5000° to 3000° C.).

Known in the art is a method for applying coatings to the surface of a product whose material is selected from the group consisting of metals, alloys, and dielectrics, said method comprising introducing into a gas flow a powder of the material selected from the group consisting of metals, alloys, their mechanical mixtures or dielectrics to form a gas and powder mixture to be directed onto the surface of the product (the book V. V. Kudinov, V. M. Ivanov. Nanesenie Plazmoi Tugoplavkikh Pokryty /Application of Refractory Coatings with Plasma/. Mashinostroenie Publishing House, Moscow. 1981, pp.9 to 14).

The prior art method is characterized in that powder particles of a size of from 40 to 100 μm are introduced into a high-temperature gas flow (5000° to 3000° C.) in the form of a plasma jet. Said powder particles are heated to the melting point or higher, the powder particles are accelerated by the plasma jet gas flow and directed to the surface being coated. Upon impingement, the powder particles interact with the surface of a product thus forming the coating. In the prior art method, the powder particles are accelerated by a high-temperature plasma jet and transferred, in molten state, to the product being coated; as a result, the high-temperature jet runs in the product to exert a thermal and dynamic effect upon its surface, i.e., causes local heating, oxidation and thermal deformations. For instance thin-walled products are heated up to 550° C., oxidized and twisted while the coating peels off.

The high-temperature jet flowing into the surface of a product intensifies chemical and thermal processes, causes phase transformations and appearance of oversaturated and non-stoichiometric structures, and hence, the structural changes in the material. Also the high level of a thermal effect on the coating results in hardening heated melts and gas liberation during crystallization which bring about the formation of evolved porosity and appearance of microcracks, i.e., impairs specifications of the coating.

It is known that, with an increase in the temperature of a plasma jet, plasma density in comparison with gas density under normal conditions linearly decreases, i.e., at 1000° C., density of the jet becomes scores of times a factor that results in a lower resistance coefficient of particles. To sum up given a plasma jet velocity of 1000 to 2000 m/s (which is about equal to, or slightly below then, the sonic velocity), the particles are accelerated up to 50 to 200 m/s (even up to 350 m/s at best), i.e., the process of acceleration is not efficient enough.

As is known with a decrease in a size of powder particles heating, melting, and overheated thereof in a plasma jet are enhanced. As a result, the, fine fractions of powder of a size from 1 to 10 μm are heated to a temperature above the melting point, and their material intensively evaporates. For this reason, the plasma deposition of particles having a size below 20 to 40 μm causes great difficulties and particles of a size from 40 to 100 μm are normally used for this purpose.

It should also be noted that the prior art method makes use of plasma jets of energy-consuming diatomic gases which call for application of high power which explains stringent requirements imposed upon the structure of apparatuses. It is only natural that limitations of the method of deposition on small-size objects are rather essential and can be eliminated through the complete removal of energy applied by cooling or providing a dynamic vacuum, i.e., by evacuation of high-temperature gases which requires high power consumption.

Therefore, the prior art method has the following disadvantages: the high level of thermal and dynamic effect on the surface being coated; substantial changes in properties of the material being applied during the coating application, such as electrical conductance, heat conductance, and the like; changes in the structure of material as a result of phase transformations and appearance of oversaturated structures following from the chemical and thermal effect of the plasma jet and the hardening of overheated melts; ineffective acceleration of powder particles resulting from low density of plasma; intensive evaporation of fine powder fractions of a size from 1 to 10 μm; stringent requirements imposed upon the structure of apparatus in view of hight-emperature processes of the prior art method.

Known in the art is an apparatus for carrying out the prior art method for applying coatings to the surface of a product, comprising a metering feeder having a casing accommodating a hopper for a powder communicating with a means for metering the powder formed as a drum having depressions in its cylindrical surface, a mixing chamber and also provided with a nozzle for accelerating powder particles communicating with the mixing chamber, a source of compressed gas, and a means connected thereto to supply the compressed gas to the mixing chamber (in the book V. V. Kudinov, V. M. Ivanov, Nanesenie Plazmoi Tugoplavkikh Pokryty /Application of Refractory Coatings with Plasma/. Mashinostroenie Publishing House, Moscow. 1981, pp.20 to 21, FIG. 11; p.26, FIG. 13).

The prior art apparatus is characterized by a plasma sprayer (plasmotron), comprising a cylindrical (subsonic) nozzle having passages for supplying a plasma-forming gas and water for cooling thermally stressed units of the plasma sprayer (namely, the nozzle) in which refractory materials are used. Powder particles are introduced from the metering feeder at the edge of the nozzle.

Since energy for forming plasma jet is applied in the form of an arc in the passage of a plasmotron nozzle, the nozzle is subjected to intensive electric erosion and high-temperature exposure. As a result, a rapid erosion wear of the nozzle occurs, the service life of which is 15 to 20 hours. With the sophisticated construction and use of refractory materials and water cooling service life can be prolonged to 100 hours.

The introduction of the particles at the edge of a nozzle and erosion of the inner duct of the nozzle lower the efficiency of acceleration of the powder particles. Thus, in combination with a low density of plasma, the prior art apparatus ensures a velocity of powder particles of up to 300 m/s with a gas escape velocity of up to 1000 m/s.

As a result of the powder getting into the space between moving parts of the metering feeder (e.g., between the drum and casing), the drum tends to be jammed.

Therefore, the prior art apparatus has the following disadvantages: short service life which is mainly determined by the service life of a nozzle of 15 to 100 hours and which is associated with the high density of a heat flux in the direction towards the plasmotron nozzle and erosion of the electrodes a factor that makes one to use expensive, refractory, and erosion-resistant materials; the inefficient acceleration of the deposited particles because the nozzle design is not optimal and is subjected to changes entailed by the electrical erosion of the inner duct; unreliable operation of the metering feeder of is the drum type which is caused by the powder getting into the space between the moving parts thus causing their jamming.

DISCLOSURE OF THE INVENTION

It is the principal object of the present invention to provide a method of and apparatus for applying a coating to the surface of a product, which allow the level of thermal and dynamic and thermal and chemical effect exerted the surface being coated and upon powder particles to be substantially lowered and initial structure of the powder material be substantially preserved, without phase transformations, appearance of oversaturated structures, and hardening during the application and formation of coatings, efficiency of acceleration of applied powder particles be enhanced, evaporation of fine fractions of the powder with a particle size from 1 to 10 μm be eliminated, a lower level of thermal and erosion exposure of the components of an apparatus be ensured, the service life of the apparatus being prolonged up to 1000 hours without using expensive, refractory and erosion-resistant materials, the operation of the duct for powder particles acceleration being improved and operation reliability of the metering feeder being enhanced, even in metering fine powder fractions.

The problem set forth is accomplished by providing a method for applying a coating to the surface of a product made of a material selected from the group consisting of metals, alloys, and dielectrics, comprising introducing into a gas flow a powder of the material selected from the group consisting of metals, alloys, mechanical mixtures thereof or dielectrics to form the gas and powder mixture which is directed onto the surface of the product, wherein, according to the invention, the powder used has a particle size of from 1 to 50 μm in an amount ensuring a mass flow rate density of the particles between about 0.05 and about 17 g/s·cm$^2$, a supersonic velocity being preset to the gas flow, and a supersonic jet of the predetermined profile being formed to assure a velocity of the gas powder mixture powder particles of from 300 to 1200 m/s.

Owing to the fact that the powder is used with a particle size of from 1 to 50 μm, denser coatings are produced, filling of the coating layer and its continuity are improved, the volume of microvoids decreases, and the structure of the coating becomes more uniform, i.e., its corrosion resistance, hardness, and strength are enhanced.

The density of a mass flow rate of the particles of between about 0.05 and about 17 g/s·cm$^2$ increases the utilization factor of the particles, hence, productivity of application. With a flow rate of particles below 0.05 g/s·cm$^2$, the utilization factor tends to zero, and with that of above 17 g/s·cm$^2$, the process becomes economically ineffective.

The presence of supersonic velocity ensures acceleration of the powder in a gas flow and lowers temperature of the gas flow owing to gas expansion with its supersonic escape. The formation of a supersonic jet of the predetermined profile with a high density and a low temperature, due to increasing resistance coefficient of particles with an increase in gas density and a decrease in temperature, contributes to a more efficient acceleration of powder particles and a decrease in the thickness of the compressed gas layer upstream of the product being coated, and hence, a lower decrease in velocity of the particles in the compressed gas layer, a decrease in the level of thermal and dynamic and thermal and chemical effect on the surface being coated and the powder particles being applied, elimination of evaporation of particles having a size of from 1 to 10 μm, preservation of the initial structure of powder material and elimination of a hardening process of the coating and thermal erosion effect on the apparatus components.

Imparting acceleration to the gas - powder mixture from 300 to 1200 m/s ensures a high level of kinetic energy to the powder particles which upon impingement of the particles against the surface of a product is transformed into plastic deformation of the particles with a bond formed with the product.

Therefore, the invention, which makes use of finely-divided powder particles of a size of from 1 to 50 μm with a density of mass flow rate of from 0.05 to 15 g/s·cm$^2$ and imparting acceleration to the powder particles through a supersonic jet of the predetermined profile with a high gas density and a low gas temperature to a velocity of from 300 to 1200 m/s substantially lower the level of thermal and dynamic and thermal and chemical effect on the surface being coated and enhances efficiency of particle acceleration which provides for the production of denser coatings, reduces the volume of microvoids therein and improves the filling of the coating layer and its continuity. This results in a uniform structure of the coating with the substantially preserved formation of the powder material without phase transformations and hardening, i.e., the coatings applied do not crack, their corrosion resistance, microhardness, and cohesion and adhesion strength are enhanced.

It is preferred that a supersonic jet of the predetermined profile be formed through gas expansion in accordance with linear principles. Such a solution provides ease of maintenance and economy of the manufacture of an apparatus for the realization of this process.

It is preferred that the gas flow use a gas having a pressure of from about 5 to about 20 atm. and is a temperature below the melting point of the powder particles. This solution promotes the efficient acceleration of powder particles on account of high density of the gas, reduces thermal and dynamic and thermal and chemical effect and also contributes to ease of maintenance and economy in the manufacture of the apparatus realizing this method.

Air can be used as the gas for forming a gas flow. This ensures the acceleration of the powder particles to a velocity of up to 300 to 600 m/s and the economy of the coating process.

It is preferred that helium be used as the gas for forming a gas flow. This imparts a velocity of from 1000 to 1200 m/s to the powder particles.

It is preferred that an air/helium mixture be used as the gas for forming a gas flow. The mixture concerned makes it possible to regulate the velocity of powder particles within the range of from 300 to 1200 m/s.

As a possible variant of controlling the velocity of particles from 300 to 1200 m/s it is technologically and economically justifiable if the gas is heated to from 30° to 400° C. which effects a saving in the application of coatings inasmuch as air is used here and also enables one to regulate the velocity of particles within wide limits.

The above problem is also solved by providing an apparatus for carrying out the method for applying a coating comprising a metering feeder having a casing incorporating a hopper for a powder communicating with a means for metering the powder formed as a drum having depressions in its cylindrical surface, and a mixing chamber and provided with a nozzle for accelerating powder particles communicating with the mixing chamber, a source of compressed gas, and a means connected thereto for supplying the compressed gas to the mixing chamber, and which, according to the invention, comprises a powder particle flow controller which is mounted in a spaced relation to the cylindrical surface of the drum, with a space ensuring the necessary flow rate of the powder, and an intermediate nozzle connected to the mixing chamber and communicating, via an inlet pipe thereof, with the means for supplying compressed gas, the metering feeder having a baffle plate mounted on the bottom of the hopper and being adjacent to the cylindrical surface of the drum which has its depressions extending along a helical line, the drum being mounted horizontally in such a mariner that one portion of its cylindrical surface defines the bottom of the hopper and the other part thereof defines the generant of the mixing chamber, particles acceleration nozzle being substantially a supersonic and having a profile passage.

The provision of the powder particle feed controller ensures the desired flow rate of the powder during coating application.

The provision of the baffle plate mounted on the hopper bottom prevents powder particles from getting into the space between the drum and the casing of the metering feeder thus preventing the drum from being jammed.

The provision of the depression on the cylindrical surface of the drum extending along a helical line lowers fluctuations of the flow rate of particles on metering.

The provision of a portion of the drum functioning as the hopper bottom and of the other portion of the drum functioning as the generant of a mixing chamber ensures the uniform filling of depressions with the powder and also reliable admission of the powder to the mixing chamber.

The provision of the supersonic nozzle having a profiled passage allows a supersonic velocity to be imparted to the gas flow and a supersonic jet of the predetermined profile to be formed with high density and low temperature so as to ensure acceleration of the powder particles of a size of from 1 to 50 μm to a velocity of from 300 to 1200 m/s.

Since the mixing chamber and the intermediate nozzle connected thereto communicate with the means for supplying compressed gas through the inlet pipe of the intermediate nozzle, the metering feeder can be supplied from different compressed gas sources including portable and stationary gas facilities which can be installed for away from the metering feeder.

It is preferred that the passage of a supersonic nozzle for acceleration of particles have one dimension of its flow-section larger than the other, with the ratio of the smaller dimension of the flow-section at the edge of the nozzle to the length of the supersonic portion of the passage ranging from about 0.04 to about 0.01.

This construction of the passage allows a gas and powder jet of the predetermined profile to be formed, ensures an efficient acceleration of the powder, and lowers velocity loss in the compressed gas layer in front of the surface being coated.

A turbulence nozzle for a gas flow leaving the compressed gas supply means may be provided on the inner surface of the intermediate nozzle, at the outlet thereof in the mixing chamber, which device agitates the flow of gas directed from the intermediate nozzle to the cylindrical surface of the drum thus assuring the effective removal of the powder and formation of the gas and powder mixture.

It is preferred that the intermediate nozzle be mounted in such a manner that its longitudinal axis extend at an angle from 80 to 850 with respect to a normal to the cylindrical surface of the drum. When the gas flow runs in the cylindrical surface of the drum, a recoil flow is formed and as a consequence of the effective mixing of the powder and gas.

It is preferred that the apparatus comprise a means for supplying compressed gas to depressions in the cylindrical surface of the drum and to the upper part of the hopper to balance pressures in the hopper and the mixing chamber. This solution eliminates the effect of pressure on the metering of the powder.

It is preferred that the means for gas supply be provided in the casing of a metering feeder in the form of a passage communicating the interior space of the intermediate nozzle to the interior space of the hopper and also comprise a tube connected to the intermediate nozzle and extending through the hopper, the top part of the tube being bent at an angle of 180°. This simplifies the design, promotes reliability in operation, and prevents the powder from getting into the passage during loading the powder into the hopper.

It is preferred that the apparatus comprise a means for heating compressed gas having a gas temperature control system for controlling the velocity of a gas and powder mixture with the supersonic jet. Such solution ensures gas escape velocity control by varying its temperature and accordingly the velocity of powder particles is also controlled.

To enhance heat transfer from a gas heater, the inlet of compressed means gas heating may be connected, through a pneumatic line to the mixing chamber of the metering feeder and the outlet can be connected to the nozzle for acceleration of powder particles.

For applying coatings of polymeric materials, it is advisable that the apparatus comprise a premix chamber at the inlet of the nozzle for acceleration of powder particles, the inlets of the means for gas heating and of the inlet pipe of the intermediate nozzle of the metering feeder being connected by means of individual pneumatic lines to a compressed gas supply and their outlets being connected to the premix chamber by means of other individual pneumatic lines.

It is preferred that the heating means be provided with a heater element made of a resistor alloy. This allows the overall dimensions of the heating means and its weight to be reduced.

To lower heat losses and enhance economic effectiveness of the apparatus, it is preferred that the heater element be mounted in a casing accommodating a heat insulator.

To make the heating means compact and ensure heating with low temperature differentials between the gas and heater element, the latter may be made in the form of a spiral of a thin-walled tube, with the gas flowing therein.

To ensure a substantial reduction of the effect of the gas supplied to the gas and powder mixture from the metering feeder on operation of the supersonic nozzle, it is preferred that the premix chamber have a diaphragm mounted in its casing and having ports for equalizing the gas flow over the cross-section and a branch pipe coaxially mounted in the diaphragm for introducing powder particles, the cross-sectional area of the branch pipe being substantially 5 to 15 times as small as the cross-sectional area of the pneumatic line connecting the gas heating means to the premix chamber.

To diminish wear of the drum, alterations of its surface, and reduce jamming, the drum may be mounted for rotation in a sleeve made of a plastic material, which adjoins the cylindrical surface of the drum.

The plastic material of the sleeve may be in the form of fluoroplastic (TEFLON). This allows the shape of the drum to be retained owing to absorption of the powder particles by the material of said sleeve.

BRIEF DESCRIPTION OF THE DRAWINGS

The invention will now be described in detail with reference to specific embodiments illustrated in the accompanying drawings, in which:

FIG. 1 is a general view of an apparatus for applying a coating to the surface of a product according to the invention, a longitudinal section;

FIG. 2 is a detail in a view taken along arrow A in FIG. 1 showing location of depressions on the cylindrical surface of a metering drum;

FIG. 3 is a cross-sectional view taken along line III—III in FIG. 1 showing the supersonic part of a nozzle;

FIG. 4 schematically shows an embodiment of an apparatus for applying a coating to the surface of a product having a gas heating means which is connected in series with its metering feeder according to the invention;

Figure 5:
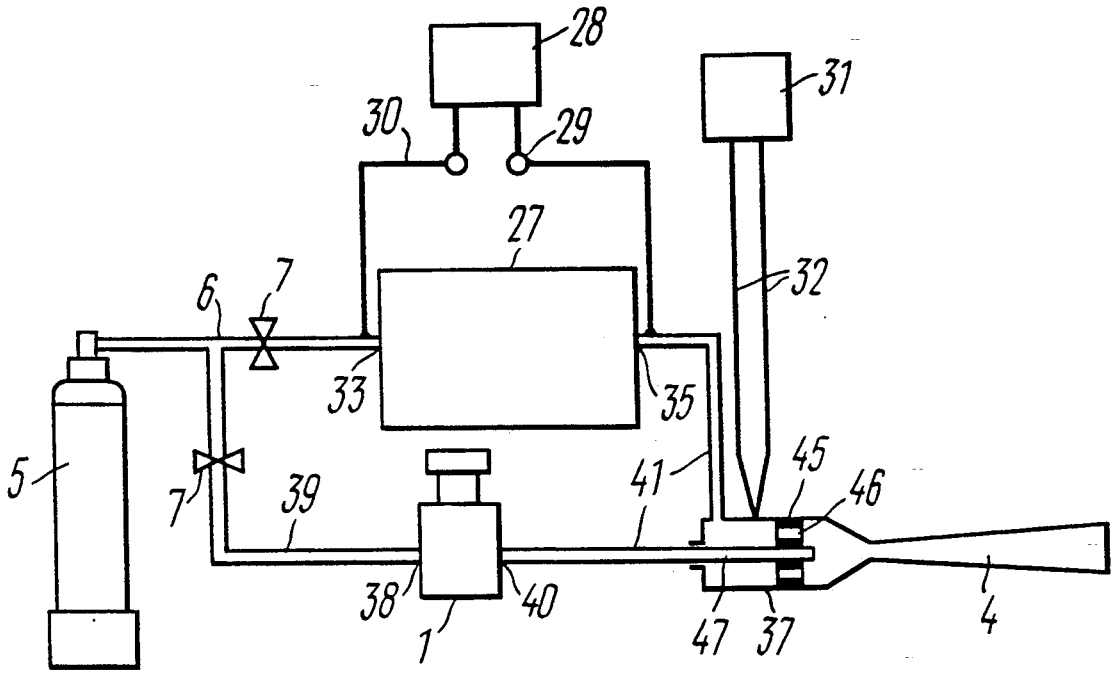
FIG. 5 is another embodiment of an apparatus according to the invention having a gas heating means connected in parallel with a metering feeder.

The invention considers a method for applying a coating to the surface of a product. The material of the product is selected from the group consisting of metals, alloys and dielectrics. In this case the material may be in the form of metal, ceramic or glass. The method consists in that a powder of a material selected from the group consisting of metals, alloys or their mechanical mixtures, and dielectrics is introduced into a gas flow to form the gas and powder mixture which is directed onto the surface of the product. According to the invention, the powder has particles of a size of from 1 to 50 μm in an amount ensuring a density of mass flow rate of the particles between 0.05 and 17 $g/s \cdot cm^2$. Supersonic velocity is imparted to the gas flow, and a supersonic jet is formed with the predetermined profile with high density and a low temperature. The resulting gas and powder mixture is introduced into the supersonic jet to impart thereto acceleration to ensure a velocity of the powder particles ranging from 300 to 1200 m/s.

If finely divided powder particles are used with the above-mentioned density of their mass flow rate, and if acceleration is imparted to the powder particles by means of a supersonic jet of the predetermined profile, which has high density and low gas temperature to a velocity ranging from 300 to 1200 m/s, a substantial decrease in the level of thermal and dynamic and thermal and chemical effection the surface being coated is ensured, and the efficiency of acceleration of the powder particles is enhanced, which results in denser coatings being produced, with a lower volume of microvoids and with enhanced continuity. The coating structure is uniform with retention of substantially the initial structure of the powder material, without phase transformations, i.e., the coatings do not crack, their corrosion resistance, microhardness, cohesive and adhesive strength are enhanced.

In accordance with the invention, the gist of the method resides in that application of coating by spraying is effected by a high-velocity flow of powder which is in solid state, i.e., at a temperature which is much lower than the melting point of the powder material. The coating is thus formed owing to the impact and kinetic energy of particles which is spent for high-speed plastic deformation of the interacting bodies in microvolumes which are commensurable with a particle size and also for local heat liberation and cohesion of particles with the surface being coated and therebetween.

The formation of a supersonic jet of the predetermined profile is carried out by expanding the gas according to a linear law, which renders the process simple and economical.

For a gas flow, use is made of gas which is under a pressure of from about 5 to about 20 atm. and at a temperature below the melting point of the powder particles, which ensures the efficient acceleration of the powder particles owing to a high density of the gas and to a lower thermal and dynamic and thermal and chemical effect.

Acceleration is imparted to the powder particles to a velocity ranging from about 300 to about 600 m/s by using air as the gas for forming a gas flow.

To impart to the powder particles a velocity ranging from 1000 to 1200 m/s, helium is used, and to impart a velocity ranging from 300 to 1200 m/s a mixture of air and helium is used.

For accelerating various materials of powder, gases are used which have different sound velocities at constant temperature, which can impart different velocities to the powder particles. For such powders as tin, zinc, aluminium, and the like, use can be made of air, an air/helium mixture in various proportions may be used for nickel, iron, cobalt, and the like. By changing the percentage of components, the velocity of a gas jet, and, accordingly the velocity of powder particles, can be varied.

Another option for controlling the velocity of particles between 300 and 1200 m/s is a change in the initial gas temperature. It is known that with an increase in gas temperature sound velocity in the gas increases. This allows the jet velocity, and accordingly the velocity of the deposited powder particles to be controlled by a weak underheating of the gas at 30° to 400° C. During expansion of the gas, when the supersonic jet is formed, the gas temperature decreases substantially which permits maintaining the thermal effect on powder particles at low level, a factor that is important in the application of polymeric coatings to products and apparatus components.

An apparatus for applying coatings to the surface of a product comprises a metering feeder (FIG. 1) having a casing 1' which accommodates a hopper 2 for a powder having a lid 2' mounted by means of thread 2'', a means for metering the powder, and a mixing chamber 3, all communicating with one another. The apparatus also has a nozzle 4 for accelerating powder particles in communication with the mixing chamber 3, a compressed gas supply 5 and a means connected thereto for supplying the compressed gas to the mixing chamber 3. The compressed gas supply means is in the form of a pneumatic line 6 which connects, via a shut-off and control member 7, the compressed gas supply 5 to an inlet pipe 8 of metering feeder 1. A powder metering means is in the form of a cylindrical drum 9 having on its cylindrical surface 9' depressions 10 and communicating with the mixing chamber 3 and with the particle acceleration nozzle 4.

According to the invention, the apparatus also comprises a powder particle flow controller 11 which is mounted in a spaced relation 12 relative to the cylindrical periphery 9' of the drum 9 so as to ensure the desired mass flow rate of the powder during coating, and an intermediate nozzle 13 positioned adjacent the mixing chamber 3 and communicating, via the inlet pipe 8, with the compressed gas supply means and with the compressed gas supply 5.

To prevent powder particles from getting into a space 14 between the drum 9 and casing 1' of the metering feeder 1 thus to avoid the jamming of the drum 9, a baffle plate 15 is provided on the hopper bottom which intimately engages the cylindrical surface 9' of the drum 9.

To ensure a uniform filling of depressions 10 with the powder and its reliable admission to the mixing chamber 3, the drum 9 is mounted to extend horizontally in such a manner that one portion of its cylindrical surface 9' is used as a bottom 16 of hopper 2 and the other portion forms a wall 17 of mixing chamber 3. Depressions 10 in the cylindrical surface 9' of the drum 9 extend along a helical line (FIG. 2), which lowers fluctuations of the flow rate of powder particles during metering. To impart to a gas flow supersonic velocity with the predetermined profile, with high density and low temperature, and also to ensure acceleration of powder particles to a velocity ranging from 300 to 1200 m/s, nozzle 4 for acceleration of the powder particles is made supersonic and has a passage 18 of profiled cross-section (FIG. 3). The passage 18 of the nozzle 4 has one dimension "a" of its flow-section which is larger than the other dimension "b", and the ration of the smaller dimension "b" of the flow-section at an edge 19 of nozzle 4 (FIG. 1) to length "1" of a supersonic portion 20 of passage 18 ranges from about 0.04 to about 0.01.

This construction of passage 20 allows a gas and powder jet of the predetermined profile to be formed, ensures efficient acceleration of the powder, and lowers velocity loss in the compressed gas layer upstream of the surface being coated.

A turbulence nozzle 21 of a compressed gas flow admitted to a nozzle 13 through the pipe 8 and leaving the means for compressed gas supply is provided on the inner surface of the intermediate nozzle 13, at the outlet thereof in mixing chamber 3. This turbulence nozzle 21 ensures an effective removal of powder and formation of a gas and powder mixture. To provide a recoil flow and ensure an effective mixing of powder and gas when the gas flow runs in the portion of the cylindrical surface 9' of drum 9 forming wall 17 of the mixing chamber 3, intermediate nozzle 13 is mounted in such a manner that its longitudinal axis 0—0 extends at an angle of from 80° to 85° with respect to a normal "n—n" drawn to the cylindrical surface 9' of drum 9.

The apparatus for applying a coating to the surface of a product also comprises a means for supplying compressed gas to depressions 10 in the cylindrical surface 9' of drum 9 and to a top part 22 of the hopper 2 to balance the pressure in the hopper 2 and the mixing chamber 3. The provision of such means removes the pressure exerts on the metering of the powder.

The means for gas supply is in the form of a passage 23 in the casing 1' of the metering feeder 1 which communicates an interior space 24 of intermediate nozzle 13 with the top part 22 of hopper 2 and has a tube 25 which is connected to the intermediate nozzle 13, extends through the hopper 2 and is bent, at its top part, at an angle of 180°.

The means constructed as described above ensures reliable operation and prevents powder from getting into the passage 23 on loading the powder into the hopper 2.

To assure control of gas escape velocity by varying its temperature, and according the velocity of powder particles, another embodiment of the apparatus has a means 27 (FIG. 4) for preheating the compressed gas and a gas temperature control system which allows gas and powder mixture velocity to be controlled when it moves through the nozzle 4 for acceleration of the powder particles.

The gas temperature control system has a power supply 28 which is electrically coupled, via terminals 29, by means of cables 30, to a gas heating means, a temperature indicator 31, and a thermocouple 32 engageable with the body of nozzle 4.

Gas heating means 27 is connected in series with metering feeder 1.

To enhance heat transfer from the heater to gas, an inlet 33 of means 27 for heating compressed gas is connected, by means of a pneumatic line 34, to the mixing chamber 3 of metering feeder 1, and its outlet 35 is connected, by means of a pneumatic line 36, to the nozzle 4 for acceleration of the powder particles.

If a coating is applied with polymeric materials, the apparatus is provided with a premix chamber 37 (FIG. 5) mounted at the inlet of nozzle 4 for acceleration of powder particles. The inlet 33 of means 27 for heating the compressed gas and an inlet 38 of metering feeder 1 are connected by means of individual pneumatic lines 39 to the compressed gas supply 5, and their outlets 35 and 40 are connected, by means of other pneumatic lines 41, to the premix chamber 37. This embodiment of the apparatus has the parallel connection of said means 27 for gas heating to the metering feeder 1. Means 27 has a casing 42 (FIG. 4) which has an inner heat insulator 43. The casing 42 accommodates a heater element 44 made of a resistor alloy in the form of a spiral of a thin-walled tube in which the gas flows.

To reduce the effect of the gas supplied from the metering feeder 1 on operation of the supersonic nozzle 4, the premix chamber 37 has a diaphragm 45 (FIG. 5) mounted therein and having ports 46 for equalizing gas velocity over the cross-section, and a branch pipe 47 mounted in the premix chamber 37 coaxially with diaphragm 45 for introducing powder particles from the metering feeder 1. The crosssectional area of branch pipe 47 is substantially 5 to 15 times as small as the cross-sectional area of the pneumatic line 41 connecting the means 27 for gas heating to the premix chamber 37.

Figure 6:
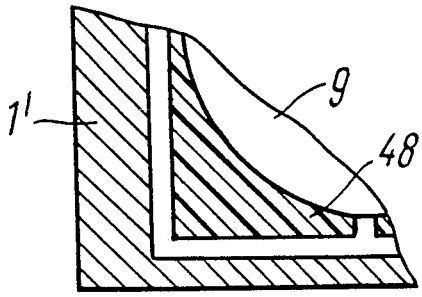
FIG. 6 is an enlarged view of a tear-out in FIG. 1.

The drum 9 is mounted for rotation in a sleeve 48 (FIG. 6) made of plastic material and being engaged with the cylindrical surface 9' of the drum 9.

The plastic material of sleeve 48 is a fluoroplastic TEFLON which ensures the preservation of the shape of drum 9 by absorbing the powder particles.

The provision of sleeve 48 lowers wear of drum 9 and reduces alterations of its surface 9', and also eliminates its jamming.

The apparatus for applying a coating shown in FIG. 1 functions in the following manner. A compressed gas from the gas supply 5 is supplied along the pneumatic line 6, via shut-off and control member 7, to the inlet pipe 8 of metering feeder 1, the gas being accelerated by means of intermediate nozzle 13 and directed at an angle of between 80° and 85° to impinge against the cylindrical surface 9' of drum 9 which is stationary and then gets into the mixing chamber 3 from which it escapes through the profiled supersonic nozzle 4. Supersonic nozzle 4 is brought to operating conditions (5 to 20 atm.) by means of the shut-off and control member 7 thus forming a supersonic gas jet at a velocity ranging from 300 to 1200 m/s.

The powder from the hopper 2 gets to the cylindrical surface 9' of drum 9 to fill depressions 10 and, during rotation of the drum, the powder is transferred into the mixing chamber 3. The gas flow formed by the intermediate nozzle 13 and turbulized by the turbulence nozzle 21 blows the powder off the cylindrical surface 9' of the drum 9 into the mixing chamber 3 wherein a gas and powder mixture is formed. The flow rate of the powder in an amount between 0.05 and 17 g/s·cm$^2$ is preset by the number of revolutions of the drum 9 and space 12 between the drum 9 and powder flow controller 11. The baffle plate 15 prevents the powder from getting into the space 14 between the casing 1' and drum 9. The gas from intermediate nozzle 13 is additionally separated along passages 23 to be admitted into the space 12 between the drum 9 and the casing 1' to purge and clean it from is the remaining powder, and through the tube 25, the gas gets into the top part 22 of the hopper 2 balances the pressure in the hopper 2 and mixing chamber 3. The gas and powder mixture from the mixing chamber 3 is accelerated in the supersonic portion 20 of the passage 18. A high-speed gas and powder jet is thus formed which is determined by the cross-sectional configuration of the passage 18 with the velocity of particles and density of their flow rate necessary for the formation of a coating. For the given profile of the supersonic portion 20 of passage 18, the density of mass flow rate of powder particles is specified by the metering feeder 1, and the velocity of particles is prescribed by the usable gas. For example, by varying the percentage of helium in a mixture with air between 0% and 100%, the velocity of powder particles can be varied between 300 and 1200 m/s.

The apparatus for applying a coating shown in FIG. 4 functions in the following manner.

The compressed gas from gas supply 5 is fed, via pneumatic line 6 and shut-off and control member 7 which adjusts the required pressure between 5 and 20 atm in the apparatus, to the metering feeder 1 whose drum 9 is stationary. The gas then flows through metering feeder 1 and to be admitted, via pneumatic line 34, to a heater element 44 of gas heating means 27 to be heated therein to a temperature between 30 and 400° C., which is specified by the gas temperature control system. The heated gas is supplied through pneumatic line 36 to the profiled supersonic nozzle 4 and escapes therefrom due to gas expansion, the gas temperature being dropped when the apparatus is brought to the preselected jet escape conditions the drum 9 of metering feeder 1 is brought to rotation and the desired concentration of powder particles is specified by means of the powder flow controller 11 and by the speed of the drum 9, and the velocity of the powder particles accelerated in the supersonic nozzle 4 is preset by varying the gas heating temperature.

In depositing the polymeric powders, the apparatus is used (FIG. 5) in which the powder from metering feeder 1 is fed directly through the branch pipe 41 to the premix chamber 37, and the gas heated in the heating means 27 passes through the ports 46 of diaphragm 45 to transfer the powder into the supersonic nozzle 4 in which the necessary velocity is imparted to the particles.

PRACTICAL EXAMPLES

EXAMPLES 1

The apparatus shown in FIG. 1 was used for coating application.

Working gas - air. Air pressure - 9 atm., flow rate—0.05 kg/s, deceleration temperature —7° C. Mach number at the nozzle edge —2.5 to 4. The material of products—steel and brass.

An aluminium powder particle size—from 1 to 25 μm, a density of flow rate of the powder—between 0.01 and 0.3 g/s·cm², a velocity of particles of from 300 to 600 m/s.

Coating conditions are given in Table 1.

TABLE 1

| No. | Flow rate density, g/s · cm² | Treatment time, T | Coating thickness, μm | Change in temperature of heat-insulated support, °C. |
|---|---|---|---|---|
| 1 | 0.01 | 1000 | — | 2 |
| 2 | 0.05 | 20 | 8 | 6 |
| 3 | 0.05 | 100 | 40 | 6 |
| 4 | 0.10 | 100 | 90 | 14 |
| 5 | 0.15 | 100 | 150 | 20 |
| 6 | 0.3 | 100 | 390 | 45 |

It can be seen from the Table 1 that the coating is formed with a flow rate density of powder from 0.05 g/s·cm² and up. With an increase in density of a powder flow rate up to 0.3 g/s·cm², the temperature of a heat insulated support increases up to 45° C. It follows from the above that coatings can be applied under the above-mentioned conditions, and products have a minimum thermal effect.

Examples 2, 3, 4, 5 and 6.

The apparatus shown in FIG. 1 was used for coating application.

The material of deposited powders—copper, aluminium, nickel, vanadium, an alloy of 50% of copper, 40% of aluminium, and 10% of iron.

The support material—steel, DURALUMIN, brass, and bronze, ceramics, glass: supports were used without heat insulation.

| | |
|---|---|
| gas pressure | 15 to 20 atm.; |
| gas deceleration temperature | 0 to 10° C.: |
| Mach number at the nozzle edge | 2.5 to 3; |
| working gas - mixture of air and helium with 50% of helium; | |
| gas flow | 20 to 30 g/s; |
| particle flow rate density | 0.05 to 17 g/s · cm². |

The velocity of particles was determined by the method of laser Doppler anemometry, and the coefficient of utilization of particles was determined by the weighing method. The results are given in Table 2.

TABLE 2

| Example No. | Particle material | Particle size, μm | Particle velocity, m/s | Coefficient of particle utilization % |
|---|---|---|---|---|
| 2 | copper | 1–40 | 650 ± 10 | 10 |
| | | | 800 ± 10 | 30 |
| | | | 900 ± 10 | 40 |
| | | | 1000 ± 10 | 80 |
| 3 | aluminium | 1–25 | 650 ± 10 | 40 |
| | | | 1000 ± 10 | 60–70 |
| | | | 1200 ± 10 | 80–90 |
| 4 | nickel | 1–40 | 800 ± 10 | 10 |
| | | | 900 ± 10 | 40 |
| | | | 1000 ± 10 | 80 |
| 5 | vanadium | 1–40 | 800 ± 10 | 10 |
| | | | 900 ± 10 | 30 |
| | | | 1000 ± 10 | 60 |
| 6 | alloy | 1–100 | 700 ± 10 | 10 |
| | | | 800 ± 10 | 20 |
| | | | 900 ± 10 | 50 |

It can be seen from Table 2 that with an increase in velocity of particles for all materials, the coefficient of utilization increases, but its values differ for different materials. The support temperature in all cases did not exceed 50° to 70° C.

After a prolonged operation with application of coatings, with the time of operation of the apparatus of at least 1000 hours, various components of the apparatus have been inspected and it has been revealed that the nozzle profile did not have any marked alterations. Thin powder material coating films were found in the area of critical cross section and the supersonic portion thereof as a result of friction with the nozzle walls during movement. These films did not have any effect on operating conditions of the nozzle. The individual occlusions of particles being deposited have been found in the fluoroplastic sleeve of the metering feeder, but the configuration of the drum and depressions of its cylindrical surface is remained substantially unchanged.

Therefore, the service life of reliable operation of the apparatus was at least 1000 hours. The absence of energy-stressed components makes the upper limit of productivity substantially unlimited.

EXAMPLE 7

The apparatus shown in FIG. 4 used for application of coatings had the following parameters: Mach number at the edge of the

| | |
|---|---|
| nozzle | 2.5 to 2.6; |
| gas pressure | 10 to 20 atm; |
| gas temperature | 30 to 400° C.; |
| working gas | air; |
| gas flow rate | 20 to 30 g/s; |
| powder flow consumption | 0.1 to 10 g/s; |
| powder particle size | 1 to 50 μm. |

The coatings were applied with particles of aluminium, zinc, tin, copper, nickel, titanium, iron, vanadium, cobalt to metal products, and the coefficient of utilization of the powder was measured (in percent) versus air heating temperature and related powder particles velocity.

The results are given in Table 3.

TABLE 3

| Powder material | Air temperature, °C. | | | | | |
|---|---|---|---|---|---|---|
| | 10 | 20 | 100 | 200 | 350 | 400 |
| aluminium | 0.1–1% | 1–1.5 | 10 | 30–60 | 90–95 | |
| zinc | 1–2 | 2–4 | 10 | 50–80 | | |
| tin | 1–30 | 80–40 | 40–60 | | | |
| copper | | | 10–20 | 50 | 80–90 | 90 |
| nickel | | | | 20 | 50–80 | 80–90 |
| titanium | | | | 50–80 | — | — |
| iron | | | | 20–40 | 60–70 | 80–90 |
| vanadium | | | | 20 | 40–50 | 60–70 |
| cobalt | | | | 20 | 40–50 | 50–60 |

It can be seen from Table 3 that when air is used as working ga at room temperature, high-quality coatings can be produced from powders of such plastic metals as aluminium, zinc, and tin. Slight air heating to 100°–200° C. resulting in an increase in particle velocity allows coatings to be produced from the majority of the above-mentioned metals. The product temperature does not exceed 60° to 100° C.

EXAMPLE 8

The apparatus shown in FIG. 5 was used for coating application.

| | |
|---|---|
| the nozzle | 1.5 to 2.6; |
| gas pressure | 5 to 10 atm; |
| gas temperature | 30 to 180° C.; |

-continued

| | |
|---|---|
| working gas | air; |
| gas flow rate | 18 to 20 g/s; |
| powder flow rate | 0.1 to 1 g/s; |
| powder particle size | 20 to 60 μm. |

A polymer powder was applied to products of metal, ceramics, and wood. A coating thickness was from 100 to 200 μm. Further thermal treatment was required for complete polymerization.

It can be seen from the above that the invention makes it possible to:

apply coatings from several dozens of microns to several millimeters thick from metals, their mechanical mixtures, alloys, and dielectrics to products of metals, alloys, and dielectrics, in particular, to ceramics and glass with a low level of thermal effect on the products;

apply coatings with fine fraction powders, with a particle size between 1 and 10 μm without phase transformations, appearance of oversaturated structures, and hardening during coating formation;

enhance the efficiency of acceleration of the powder by using high-density compressed gases;

substantially lower thermal effect on apparatus components.

The construction of the apparatus ensures its operation during at least 1000 hours without employment of expensive erosion-resistant and refractory materials, high throughput capacity which is substantially unlimited because of the absence of thermally stressed components which enables one to incorporate apparatus into standard flow lines to which it can be readily matched as regards throughput capacity, e.g., in a flow line for the manufacture of steel pipes having protective coatings of zinc, aluminium and stainless steel.

Industrial Applicability

The invention can be most advantageously used, from the manufacturing and economic point of view in restoring the geometrical dimensions of worn parts, in increasing wear resistance, in protecting of ferrous metals against corrosion.

The invention may be most advantageously used in metallurgy, mechanical engineering, aviation, ship building, agricultural machine building, in the automobile industry, in the instrument making and electronic technology for the application of corrosion-resistant, electrically conducting, antifriction, surface-hardening, magnetically conducting, and dielectric coatings to parts, structures, and equipment which are manufactured, in particular, of materials capable of withstanding a limited thermal effect and also to large-size objects such as sea-going and river vessels, bridges, and large diameter pipes.

The invention may also find application for producing multiple-layer coatings and combined (metal-polymer) coatings as part of comprehensive manufacturing processes for producing materials with expected properties.

We claim:

1. A gas-dynamic spraying method for applying a coating to an article, the method comprising:

introducing into a gas particles of a powder of at least one first material selected from the group consisting of a metal, alloy, polymer and mechanical mixture of a metal and an alloy, the particles having a particle size of from about 1 to 50 microns;

forming the gas and particles into a supersonic jet having a temperature sufficiently low to prevent thermal softening of the first material and a velocity of from about 300 to about 1,200 m/sec.; and directing the jet against an article of a second material selected from the group consisting of a metal, alloy and dielectric, thereby coating the article with the particles.

2. The method of claim 1, wherein the gas is selected from the group consisting of air, helium and a mixture of air and helium.

3. The method of claim 1, wherein the temperature of the jet is room temperature, the gas is air, the first material is aluminum and zinc and a flow rate of the particles in the jet is at least 0.05 g/sec. $cm^2$.

4. The method of claim 1, wherein the temperature of the jet is from about 30° C. to about 400° C.

5. The method of claim 2, wherein the temperature of the jet is from about 30° C. to about 400° C.

6. The method of claim 1, wherein forming the jet comprises forming the jet with a cross section having one maximum dimension bigger than a perpendicular maximum dimension.

* * * * *

US005302414B1

REEXAMINATION CERTIFICATE (3141th)

United States Patent [19] [11] B1 5,302,414

Alkhimov et al. [45] Certificate Issued Feb. 25, 1997

[54] GAS-DYNAMIC SPRAYING METHOD FOR APPLYING A COATING

[75] Inventors: Anatoly P. Alkhimov; Anatoly N. Papyrin, ulitsa Vyazemskogo 2, kv. 72; Vladimir F. Kosarev; Nikolai I. Nesterovich; Mikahil M. Shushpanov, all of Novosibirsk, Russian Federation

[73] Assignee: Anatoly Nikiforovich Papyrin, Novosibirsk, Russian Federation

Reexamination Request:
No. 90/004,204, Apr. 3, 1996

Reexamination Certificate for:

| | |
|---|---|
| Patent No.: | **5,302,414** |
| Issued: | **Apr. 12, 1994** |
| Appl. No.: | **781,233** |
| Filed: | **May 19, 1990** |

[22] PCT Filed: May 19, 1990

[86] PCT No.: PCT/SU90/00126

§ 371 Date: Feb. 2, 1992

§ 102(e) Date: Feb. 2, 1992

[87] PCT Pub. No.: WO91/19016

PCT Pub. Date: Dec. 12, 1991

[51] Int. Cl.[6] ..... B05D 1/12

[52] U.S. Cl. ..... 427/192; 427/191; 427/195

[58] Field of Search ..... 427/446

[56] References Cited

U.S. PATENT DOCUMENTS

| | | | |
|---|---|---|---|
| 2,714,563 | 8/1955 | Poorman et al. | 427/446 |
| 2,861,900 | 11/1958 | Smith et al. | 117/105 |
| 3,100,724 | 8/1963 | Rocheville | 48/308 |
| 4,235,943 | 11/1980 | McComas et al. | 427/34 |
| 4,256,779 | 3/1981 | Sokol et al. | 427/34 |
| 4,289,807 | 9/1981 | Christensen et al. | 427/195 |
| 4,416,421 | 11/1983 | Browning | 239/79 |
| 4,815,414 | 3/1989 | Duffy et al. | 118/308 |
| 4,928,879 | 5/1990 | Rotolico | 239/8 |
| 5,019,429 | 5/1991 | Moskowitz et al. | 427/422 |
| 5,302,414 | 4/1994 | Alkhimov et al. | 427/192 |

OTHER PUBLICATIONS

"30,000 Degrees with the Plasma Jet", Jour. of Metals, (Jan. 1959) pp. 40–42.

*Primary Examiner*—Shrive Beck

[57] ABSTRACT

A cold gas-dynamic spraying method for applying a coating to an article introduces into a gas particles of a powder of a metal, alloy, polymer or mechanical mixture of a metal and an alloy, the particles having a particle size of from about 1 to about 50 microns. The gas and particles are formed into a supersonic jet having a temperature considerably below a fusing temperature of the powder material and a velocity of from about 300 to about 1,200 m/sec. The jet is directed against an article of a metal, alloy or dielectric, thereby coating the article with the particles.

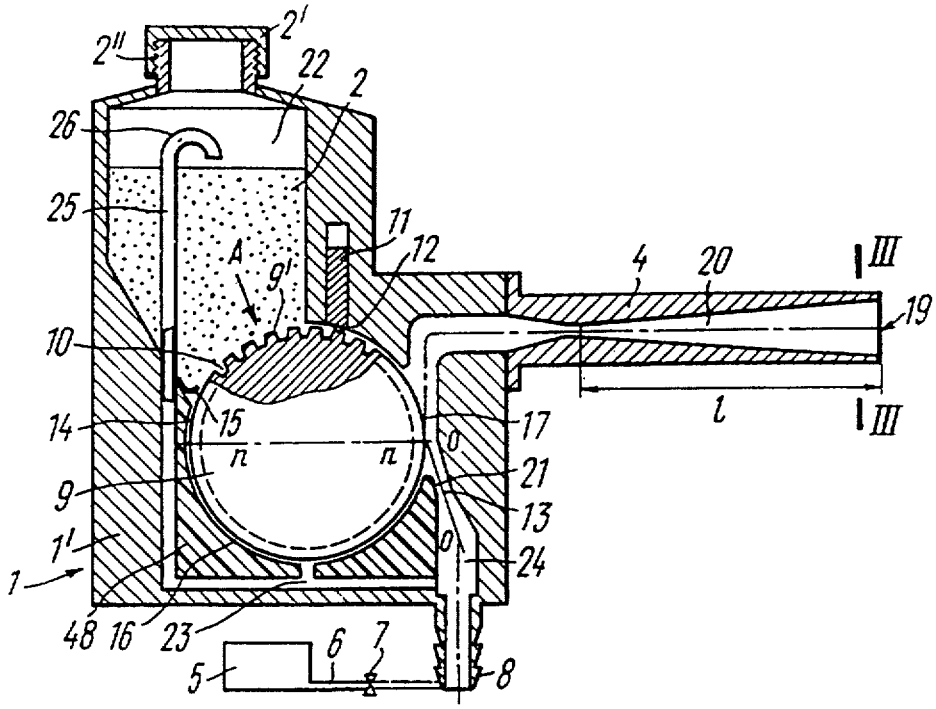

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–6, dependent on an amended claim, are determined to be patentable.

1. A gas-dynamic spraying method for applying a coating *of particles* to an article, *the coating being formed of a cohesive layering of particles in solid state on the surface of the article,* the method comprising:

[introducing into a gas] *mixing* particles of a powder of at least one first material selected from the group consisting of a metal, alloy, polymer and mechanical mixture of a metal and an alloy *into a gas*, the particles having a particle size of from about 1 to 50 microns;

[forming] *following the step of mixing the gas and particles, accelerating* the gas and particles into a supersonic jet [having a temperature] *while maintaining the temperature of the gas and particles* sufficiently low *so as* to prevent *melting or* thermal softening of the first material [and], *said particles having* a velocity of from 300 to about 1,200 m/sec.; and directing the jet *of gas and particles in solid state* against an article of a second material selected from the group consisting of a metal, alloy and dielectric; thereby coating the article with [the] *a desired thickness of* particles.

* * * * *